US008318083B2

(12) United States Patent
Pankiw et al.

(10) Patent No.: US 8,318,083 B2
(45) Date of Patent: Nov. 27, 2012

(54) CAST HEAT-RESISTANT AUSTENITIC STEEL WITH IMPROVED TEMPERATURE CREEP PROPERTIES AND BALANCED ALLOYING ELEMENT ADDITIONS AND METHODOLOGY FOR DEVELOPMENT OF THE SAME

(75) Inventors: Roman I Pankiw, Greensburg, PA (US); Govindarajan Muralidharan, Knoxville, TN (US); Vinod Kumar Sikka, Oak Ridge, TN (US); Philip J. Maziasz, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 12/839,844

(22) Filed: Jul. 20, 2010

(65) Prior Publication Data

US 2010/0303669 A1 Dec. 2, 2010

Related U.S. Application Data

(63) Continuation of application No. 11/567,944, filed on Jul. 31, 2007, now abandoned.

(51) Int. Cl.
*C22C 30/00* (2006.01)

(52) U.S. Cl. ..... 420/584.1; 148/327; 148/442; 420/43; 420/53; 420/586; 420/586.1

(58) Field of Classification Search ..... 148/320, 148/325, 327, 426, 427, 442; 420/34, 36–38, 420/43, 50, 52–57, 67–69, 94–98, 123–127, 420/452–454, 584.1–586.1
See application file for complete search history.

(56) References Cited

U.S. PATENT DOCUMENTS

| | | | | |
|---|---|---|---|---|
| 3,459,539 | A * | 8/1969 | Eiselstein et al. | 420/54 |
| 4,086,107 | A * | 4/1978 | Tanino et al. | 148/611 |
| 4,410,362 | A * | 10/1983 | Sugitani et al. | 420/584.1 |
| 5,077,006 | A * | 12/1991 | Culling | 420/584.1 |
| 7,749,432 | B2 * | 7/2010 | Muralidharan et al. | 420/53 |

FOREIGN PATENT DOCUMENTS

| | | | |
|---|---|---|---|
| GB | 2394959 | A * | 5/2004 |
| JP | 52119411 | A * | 10/1977 |
| JP | 05001355 | A * | 1/1993 |

OTHER PUBLICATIONS

English language machine translation of JP 2001247940.*
G. Muralidharan et al., Development of Stronger and More Reliable Cast Austenitic Stainless Steels . . . , CRADA Final Report, Apr. 2006, pp. 1-50.
R. Pankiw et al., Development of Stronger and More Reliable Cast Austenitic Stainless Steels . . . , Final Technical Report, Jun. 2006, pp. 1-64.

* cited by examiner

*Primary Examiner* — Stanley Silverman
*Assistant Examiner* — Brian Walck
(74) *Attorney, Agent, or Firm* — Edna I. Gergel

(57) ABSTRACT

The present invention addresses the need for new austenitic steel compositions with higher creep strength and higher upper temperatures. The new austenitic steel compositions retain desirable phases, such as austenite, $M_{23}C_6$, and MC in its microstructure to higher temperatures. The present invention also discloses a methodology for the development of new austenitic steel compositions with higher creep strength and higher upper temperatures.

11 Claims, 9 Drawing Sheets

CAST HEAT-RESISTANT AUSTENITIC STEEL WITH IMPROVED TEMPERATURE CREEP PROPERTIES AND BALANCED ALLOYING ELEMENT ADDITIONS AND METHODOLOGY FOR DEVELOPMENT OF THE SAME

This application is a continuation of U.S. application Ser. No. 11/567,944 filed on Jul. 31, 2007, now abandoned. The specification[s] of U.S. application Ser. No. 11/567,944 is hereby incorporated by reference in their entirety.

PRIORITY TO PROVISIONAL APPLICATIONS

This application hereby claims priority to provisional application Ser. No. 60/748,239, filed on Dec. 7, 2005, and provisional application Ser. No. 60/789,905, filed on Apr. 6, 2006. Both applications are incorporated herein by reference.

STATEMENT OF FEDERAL FUNDING

The United States government has rights to this invention pursuant to contract no. DE-AC05-00OR22725 between the United States Department of Energy and UT-Battelle, LLC. This invention was made under Cooperative Research and Development Agreement ("CRADA") ORNL 02-0632 between Duraloy Technologies, Inc. and UT-Battelle, LLC.

BACKGROUND OF THE INVENTION

The present invention addresses the need for new austenitic steel compositions with higher creep strength and higher upper temperatures as compared to the presently used H-Series of cast stainless steels. Heat-resistant cast austenitic stainless steels and alloys are the backbone of the chemical, petrochemical, heat-treating and metals processing industries today, with applications continuing to drive performance, durability and use-temperatures higher, while economics tries to lower the cost of such alloys. There is a significant and continued need for low-cost austenitic stainless steel alloys that can be used in the as-cast condition at high temperatures up to 1200° C. Alloys currently used for this purpose have a significant Nickel (Ni) content added (~35-45 wt. %), a large Cobalt (Co) content (up to 15 wt. %), or a large Tungsten (W) or Molybdenum (Mo) content. For these alloys, creep properties at 1200° C. can vary widely within the composition ranges specified in these inventions and a better definition of alloy compositions is needed for optimum creep properties for the temperature range of operation.

The alloy compositions of the present invention are designed specifically for improved creep properties at high temperatures of up to and including about 1200° C. Microstructure is a unique characteristic of the alloys of the present invention and forms the basis of their high temperature strength. The key problems solved by the present invention are the reduction of Cobalt (Co) content and the need for only small quantities of other alloying elements. The microstructure design creates a stable austenite resistant and an optimum combination of MC and $M_{23}C_6$ carbides, which is promoted through the addition of alloying elements.

For service temperatures above 850° C. to 900° C., the dominant alloy for use in steam methane reforming or ethylene cracking applications was initially HK-40 stainless steel. More recently modified or micro-alloyed HP stainless alloys have been used for these applications. In 1941, the Alloy Casting Institute introduced the classifications used today, designating the heat-resistant grades as H-grades and the corrosion-resistant stainless steels and alloys as C-grades. Fairly complete descriptions of properties, compositions, and standard industrial practice for the various grades of cast austenitic stainless steels and alloys can be found in handbooks or data available from the Steel Founders Society of America, ASM International, The Nickel Development Institute, The Specialty Steel Industry of North America, and/or data sheets compiled by the various leading alloy casters. The HK-40 stainless steel is essentially a Fe-25Cr-20Ni-0.4C alloy, whereas HP-40 stainless alloy is Fe-25Cr-35-Ni-0.4C, with more creep-resistant modifications occurring in the HP modified (+Nb) or the HP micro-alloyed (+Nb+Ti or +Nb+Zr) materials. In the 1960s and 1970s, efforts to improve the carburization-resistance of the HK-40 steels led to additions of up to 2% Silicon (Si) and increases in Nickel (Ni) (IN-519, 25Cr-25Ni-1.5Nb and HP alloys), while efforts to increase the strength and creep-resistance added Niobium (Nb). Costly upgrades of the modified HP alloys include additions of Tungsten (W) and Cobalt (Co) to further increase the high-temperature strength.

The native microstructure established in these fully-austenitic alloys consists of dendritic structures of austenite matrix with finer dispersions of carbides (Cr-rich $M_{23}C_6$ or Nb-rich MC, depending on the alloy), and heavier clusters of NbC in the interdendritic regions (the last liquid to solidify) and dispersions of $M_{23}C_6$ along the seams between colonies of dendrites. Aging effects can vary, with little deleterious effects above 950° C. to 1000° C., particularly in the modified HP alloys, but with potential embrittlement (severe ductility loss at ambient temperatures) due to $M_{23}C_6$ films and/or sigma phase formation during prolonged exposure below 900° C., mainly in the HK-40 type alloy. Additions of Cobalt (Co) are made mainly to strengthen and stabilize the austenite matrix phase, while additions of Tungsten (W) promote solid solution strengthening as well as Tungsten Carbide (WC) formation. Ethylene cracking and radiant furnace tubes generally involve prolonged exposure at relatively steady temperatures, where creep-resistance and oxidation/corrosion resistance are the life-defining properties. However, materials processing applications of such alloys, including steel mill furnace rollers and retorts for calcining, involve more than just creep-strength, and must include thermal fatigue resistance to prevent surface cracking (critical for coiling drums) or catastrophic through-section fracture (retorts). While one can possibly use the more expensive chemical/petrochemical premium alloys for such materials processing equipment applications, the materials processing industries probably would be better served by improving the strength and aging resistance of the standard HK-40 grade steel to provide a more cost-effective solution.

Alloy development of complex engineering alloys based on single or multiple alloying element additions or changes over wide ranges can often be very labor intensive, time consuming and costly. Usually such traditional brute-force efforts produce only modest incremental improvements, and then such improvements must be further verified by testing relevant to real-time component service. Therefore, most applications engineers attempt to redesign components or to solve their materials problems by selecting alternate materials, and they only turn to traditional alloy development as a last resort.

A far more scientific and yet practical method of precise microstructural analysis and identification of the degradation/failure mechanisms was devised at Oak Ridge National Laboratory to improve the creep-resistance of 300-series austenitic stainless steels at about 700° C. to about 800° C. This method provided a framework for translating various single or combined alloying element effects directly into their effects on precipitation behavior or stability of the parent matrix phase (austenite). When this scientific knowledge of how to stabilize desirable phases and reduce or eliminate undesirable phases was coupled with a thorough knowledge of microstructure/properties relationships and failure mechanisms, precise microstructures were designed that produced outstanding long-term creep-resistance the first time those modified stainless steels and alloys were made. The alloying addition effects were classified as (a) direct reactant effects (i.e., Nb+C=NbC), (b) catalytic effects (i.e., solutes that enhance the formation of a phase even though they are not direct reactants, like Silicon (Si) enhancing the formation of $Fe_2Mo$ Laves phase or Boron (B) enhancing the formation of TiC or $M_{23}C_6$ carbides), (c) inhibitor effects (i.e., solutes that retard or prevent the formation of particular precipitate phases, like Carbon (C), Boron (B), and Phosphorus (P) retarding or preventing the formation of intermetallic phases like sigma, chi or Laves), and (d) interference effects (i.e., two or more phases competing for the same element to decouple or simplify phase behavior and control in complex alloys). Some of the microstructural effects that have been controlled to create extremely long-term creep-rupture resistance include: (a) the elimination of creep voids; (b) the promotion of fine dispersions of MC carbides; (c) the prevention of dissolution or coarsening of fine MC carbides; (d) the delay or prevention of the formation of embrittling grain-boundary intermetallic phases; and (e) the prevention of dislocation recovery or recrystallization (mainly for wrought alloys).

As discussed more fully below, the related art recognizes and discusses previous efforts to obtain the improved alloys of the present invention. However, these efforts suffered from various shortcomings, including the need for costly element additions and low creep lives at high temperatures.

For example, U.S. Pat. No. 3,627,516 describes Fe—Ni—Cr alloys with a preferred composition of 26% Chrominium, 32% Nickel, 0.4% Carbon, 1.1% Manganese, 1.2% Silicon, 0.08% Nickel, 1.2% Niobium and the rest Iron for use at temperatures ranging from 800° C. to 1200° C. This patent also notes that 0.5% to 1.5% Molybdenum was beneficial in some cases. The present invention, on the other hand, identifies alloys with higher Nickel content. Niobium (Nb) contents in the present invention are also higher than in the alloys identified in U.S. Pat. No. 3,627,516 (thus lower overall costs). Molybdenum (Mo) contents are also lower in the present invention, which, again, is different from the related art.

Similarly, U.S. Pat. No. 3,758,294 discloses improved alloys with additions of 0.18% Nitrogen, 1.7% Tungsten, and 1.3% Niobium. The preferred embodiment including resistance to carburization included 0.4 wt. % Carbon, 25 to 28 wt. % Chromium, 32 to 36% Nickel, 0.5 to 1.0% Manganese, 1.2 to 1.6% Silicon, 1.4 to 2.0% Tungsten, 1.0 to 1.8% Niobium and 0.15% Nitrogen. Comparison of the creep life of the alloys identified in U.S. Pat. No. 3,627,516 and U.S. Pat. No. 3,785,294 with those in the present invention reveals that the present invention's new alloys possess improved creep properties at about 1200° C. Thus, improved properties were obtained with much lower alloying element additions, particularly Tungsten (W) and Niobium (Nb), and without the addition of Nitrogen (N).

U.S. Pat. No. 4,853,185 and U.S. Pat. No. 4,981,674 identify Fe—Ni—Cr alloys with 25-45% Nickel, 12-32% Chromium, 0.1 to 2.0% Niobium (minimum of nine times Carbon content), 2.0% Titanium max, 3% Silicon max, 0.05-0.5% Nitrogen, 0.02 to 0.2% Carbon, 2.0% Manganese max, 1.0% Aluminum max, 5.0% Tungsten/Molybdenum max, 0.02% Boron max, 0.2% Zirconium max, 5% Cobalt max, Yttruim, Lanthanum, Copper, REM up to 0.1% max. At least one Niobium, Tantalum, or Vanadium has to be present in the alloy along with Carbon and Nitrogen. Niobium (Nb) has to be added to a level of at least nine times the Carbon content. In contrast, the alloys of the present invention need no additions of Tantalum (Ta) or Vanadium (V) with very small simultaneous additions of Niobium (Nb), Tungsten (W), and Molybdenum (Mo). In addition, no Nitrogen (N) is intentionally added in the alloys of the present invention and thus the concentration can be much lower than 0.05%. Furthermore, the Carbon (C) levels in the present invention's alloys are much larger than those identified by Rothman et al.

In related art, U.S. Pat. No. 4,615,658 teaches a material for gas turbine shrouds that contains 0.35 to 0.5 wt. % Carbon, 22 to 24 wt. % Chromium, 24 to 26 wt. % Nickel, 0.15 to 0.35 wt. % Titanium, 0.2 to 0.5 wt. % Niobium, 0.1 to 1.2 wt. % Manganese, less than 0.8 wt. % Silicon and the balance Iron. Also suggested were additions of 0.05 to 5 wt. % rare-earth elements, 5 to 20 wt. % Cobalt, less than 7 wt. % Tungsten, and less than 7 wt. % Molybdenum. The present invention does not require Cobalt (Co) and rare-earth elements. Further, U.S. Pat. No. 4,615,658 does not show the creep properties of the alloys at high temperatures, and the amount of Tungsten (W) required by the invention of U.S. Pat. No. 4,615,658 is significant, which influences the cost and other alloy properties.

U.S. Pat. No. 6,485,674 discloses a heat resistant austenitic stainless steel with 0.04 to 0.1% Carbon, not more than 0.4% Silicon no more than 0.6% Manganese, 20 to 27% Chromium, 22.5 to 32% Nickel, not more than 0.5% Molybdenum, 0.2 to 0.6% Niobium, 0.4 to 4.0% Tungsten, 0.1 to 0.3% Nitrogen, 0.002 to 0.008% Boron, less than 0.05% Aluminum, and at least one of Calcium or Manganese. The alloys of the present invention contain a larger amount of Carbon (C), are able to accept more Silicon (Si) and Manganese (Mn) do not need any Nitrogen (N) or Calcium (Ca) additions, and achieve excellent heat resistance at temperatures up to 1200° C.

U.S. Pat. No. 6,685,881 discloses an austenitic stainless steel for use up to 950° C. with good heat resistance and machinability. The compositions of those alloys are in the range of 0.2 to 0.4% Carbon, 0.5 to 2.0% Silicon, 0.5 to 2.0% Manganese, 8 to 42% Nickel, 15 to 28% Chromium, 0.5 to 7.0% Tungsten, 0.5 to 2.0% Niobium, up to 0.05% Titanium, up to 0.15% Nitrogen, 0.001 to 0.5% Selenium, up to 0.1% Phosphorus, and 0.04 to 0.2% Sulfur. The present invention alloys have good heat resistance up to about 1200° C. In addition, the Tungsten (W) and Niobium (Nb) contents of the present invention alloys are much lower with no intentional additions of Nitrogen (N). The creep lives of the alloys in the U.S. Pat. No. 6,685,881 are not specified.

In summary, the present invention increases the high-temperature strength and upper use temperature of H-Series of cast austenitic stainless steels without the requirement of certain costly element additions. The present invention may be used in, among other things, steam methane reformer tubes, ethylene cracking furnace tubes, radiant furnace tubes, steel mill furnace transfer rollers, and retorts for calcining. The result is a significant energy and cost savings each year.

SUMMARY OF THE INVENTION

The present invention deals with the development of new cast heat-resistant austenitic alloys whose compositions are scientifically designed based on an understanding of the effect of alloying elements on the thermodynamic stabilities and compositions of various phases in the Fe—Cr—Ni alloy system. One of the unique aspects of this invention is the addition of balanced quantities of alloying elements achieved through thermodynamic calculations. These thermodynamic calculations are used to calculate the stabilities and compositions of various phases as a function of alloying element content. Using such calculations, desirable phases such as austenite, $M_{23}C_6$, and MC have been retained in the microstructure to higher temperatures. Moreover, the new alloys contain an optimum combination of complex carbides with alloying element additions enhancing their stability. For example, Tungsten (W) and Molybdenum (Mo) improve the stability of $M_{23}C_6$, while Molybdenum (Mo) and Niobium (Nb) improve the stability of MC carbides. The new compositions, when tested at about 2200° F. (1204° C.), showed improved properties when compared with standard HP and HP modified alloys.

Although there is a need for alloys with improved high-temperature strength properties, very little work has been performed in recent times on improving the properties of H-series alloys. One of the reasons for the lack of significant efforts is the cost and time associated with development of new alloys through traditional methods. Alloy development using traditional Edisonian methods involves repeated cycles of trial-and-error additions of alloying elements, followed by extensive experimental work to fabricate and test the alloys. This work entails extensive labor, time and thus cost, with no assurance of success. Furthermore, with multiple alloying element additions, possible permutations and combinations can be extensively large and prohibitively expensive. In recent times, using the vast amount of experimental data available, significant advances have been made in computational thermodynamic and kinetic models to describe alloy phase equilibria and microstructural evolution. The present invention uses these computer models to test the effect of adding a certain element on the phase equilibria without actually preparing the alloy, thus replacing the traditional trial-and-error methods. This computer-aided alloy development work significantly reduces the cost and time of the development effort and is thus one of the important features of the present invention. The alloys of the present invention were developed by searching alloy composition phases for alloying element additions that would result in a desirable microstructure, with the following experimental work limited to a selected number of potentially promising alloys.

The present invention teaches a novel methodology for the development of new cast heat-resistant austenitic alloys. The alloy compositions of the present invention were developed to primarily increase the high-temperature creep strength of existing HP- and HK-type alloys. It was determined that the presence of both types of carbides, $M_{23}C_6$ and MC, had a positive influence of the high-temperature creep properties of alloys. To understand the stabilities of these carbides in existing alloys, thermodynamic calculations were carried out using computational tools. The results of these calculations showed that $M_{23}C_6$ phase dissolution at temperatures between about 2100-2200° F. (depending on the composition of the alloy) was one of the most important factors responsible for the loss in strength. Using computational thermodynamics, the effects of adding various other elements on the stabilities of the carbide phases were determined, and additional alloying element additions were selected to increase the stability of those phases at high temperatures. In addition, alloy composition was optimized to remove or minimize expensive alloying elements such as Tungsten and Cobalt used for strengthening the matrix through solid solution strengthening in alloys such as Supertherm®. Since computational thermodynamics can predict the stability of deleterious phases such as sigma, alloy composition was also optimized to decrease the stability of that phase over the temperature range of interest.

A preferred embodiment of the cast heat-resistant austenitic steel alloy with improved temperature creep properties and balanced alloyed element additions of the present invention includes about 0.4 to about 0.7 wt. % Carbon; about 20 to about 35 wt. % Chromium; about 30 to about 45 wt. % Nickel; about 0.5 to about 1.5 wt. % Manganese; about 0.6. to about 2.0 wt. % Silicon; up to about 1.5 wt. % Niobium; up to about 1.5 wt. % Tungsten; up to about 1.5 wt. % Molybdenum; and, the remainder being Iron. The alloy further optionally comprises about 0.01 to about 1.0 wt. % Titanium, about 0.01 to about 1.0 wt. % Zirconium and about 0.02 wt. % Cobalt. The creep life of the alloy at about 1200° C. and about 500 psi is in excess of about 600 hours and the total wt. % of carbides in the alloy at about 1200° C. is between about 3.18 and about 7.84. $M_{23}C_6$ and MC carbides are present in the microstructure of the alloy at high temperatures up to about 1204° C.

The method of the present invention specifically includes the steps of evaluating compositions of HP and HK alloys; calculating the effect of an addition of alloying elements on the stability of $M_{23}C_6$ and MC utilizing thermodynamic models, using the HP and HK alloys as a base reference for the calculations, and wherein the alloying element additions are used to stabilize strengthening phases at a required temperature as indicated by the results of the thermodynamic calculations to provide improved creep-resistance.

BRIEF DESCRIPTION OF THE DRAWINGS

For the present invention to be easily understood and readily practiced, the invention will now be described, for the purposes of illustration and not limitation, in conjunction with the following figures, wherein:

FIG. 7(*b*) illustrates the creep strain as a function of time obtained during testing at about 2200° F. (1204° C.) and about 500 psi, showing that failure occurred after about 14 hours.

DETAILED DESCRIPTION OF THE INVENTION

Figure 1:
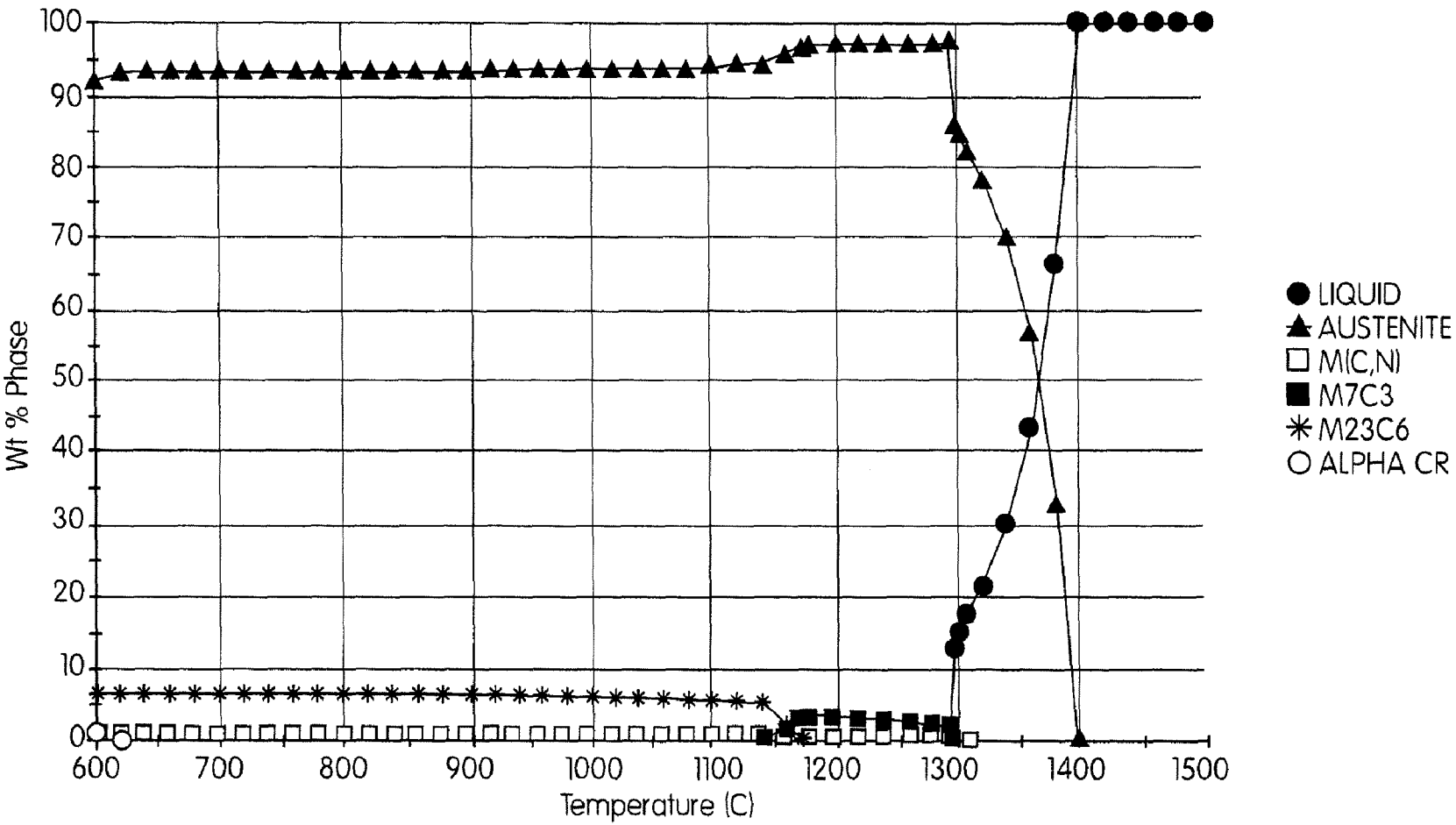
FIG. 1 illustrates equilibrium thermodynamic calculations showing phases present at various temperatures in the HP-7 alloy, having a composition of: about 0.41 wt. % C, about 23.6 wt. % Cr, about 34.6 wt. % Ni, about 1.0 wt. % Mn, about 0.7 wt. % Si, about 0.05 wt. % Mo, about 0.33 wt. % Nb, about 0.08 wt. % W, about 0.1 wt. % Ti, and the rest Fe.
Figure 2:
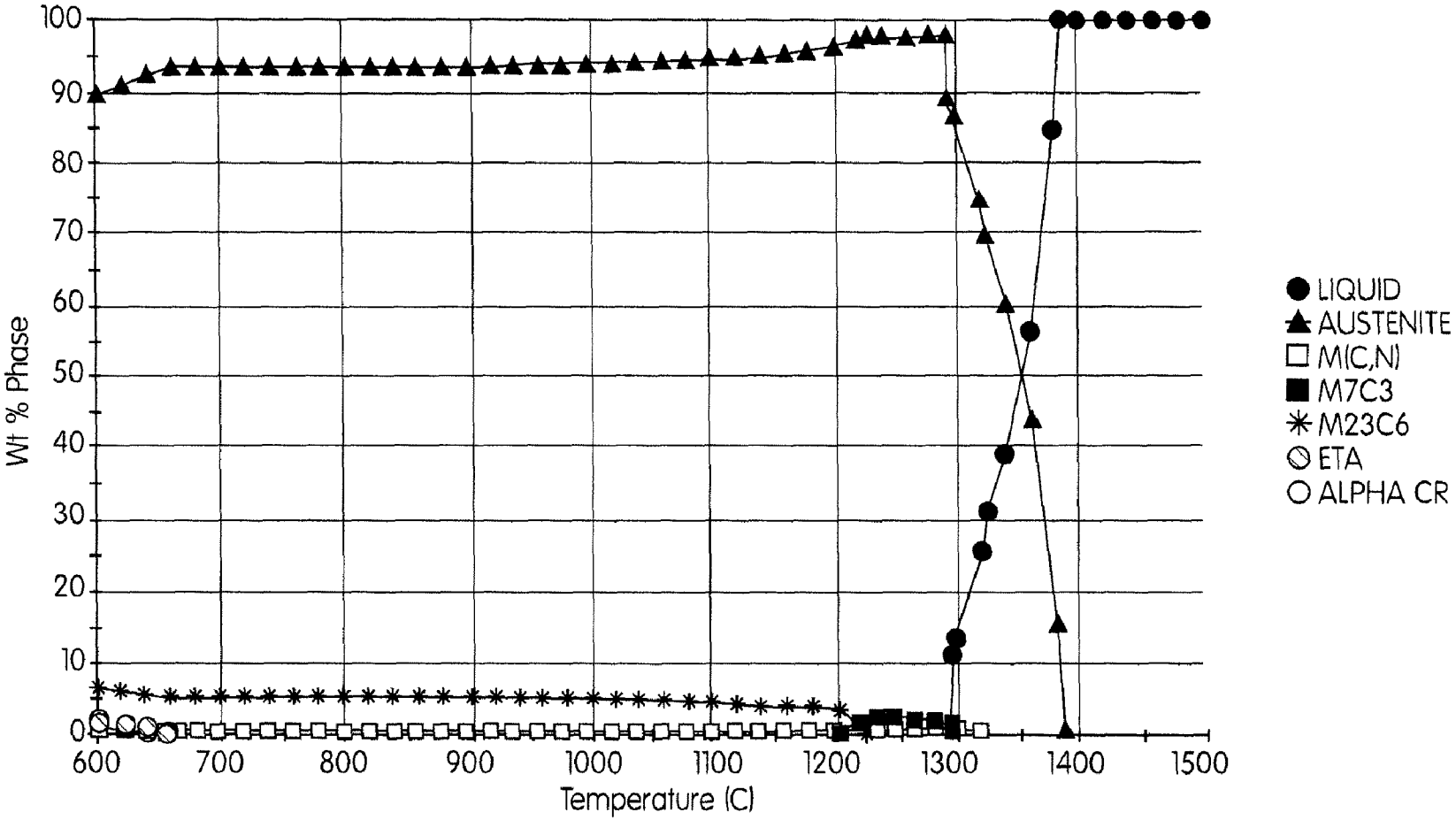
FIG. 2 illustrates equilibrium thermodynamic calculations showing phases present at various temperatures in the HP-15 alloy, having a composition of: about 0.42 wt. % C, about 23.7 wt. % Cr, about 35.1 wt. % Ni, about 1.1 wt. % Mn, about 0.7 wt. % Si, about 0.28 wt. % Mo, about 0.34 wt. % Nb, about 0.07 wt. % W, about 0.4 wt. % Ti, about 0.1 wt. % Zr, and the rest Fe.
Figure 3:
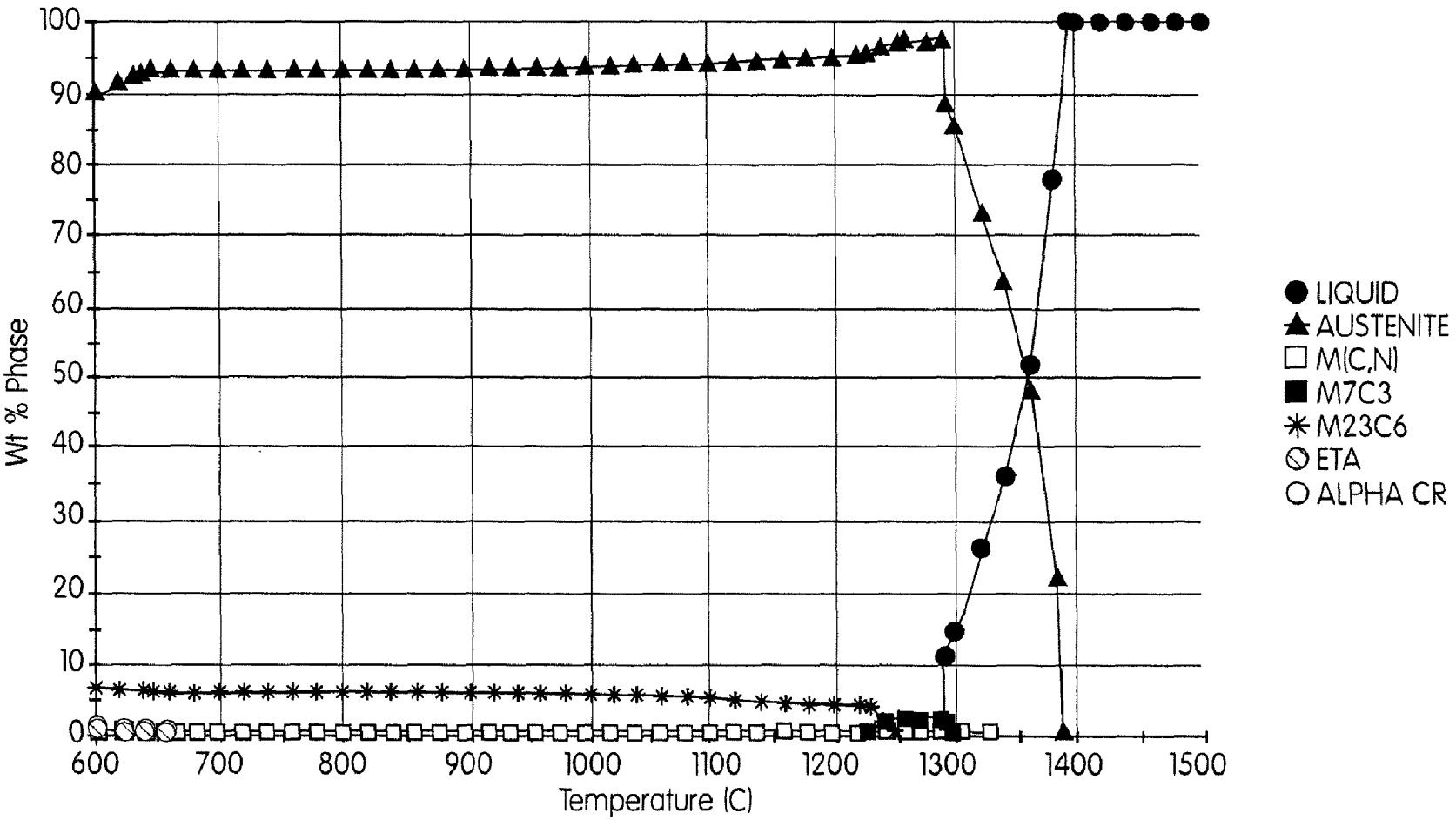
FIG. 3 illustrates equilibrium thermodynamic calculations showing phases present at various temperatures in HP-16 alloy, having a composition of: about 0.41 wt. % C, about 23.4 wt. % Cr, about 34.34 wt. % Ni, about 1.0 wt. % Mn, about 0.7 wt. % Si, about 0.5 wt. % Mo, about 0.34 wt. % Nb, about 0.1 wt. % W, about 0.3 wt. % Ti, and the rest Fe.
Figure 4:
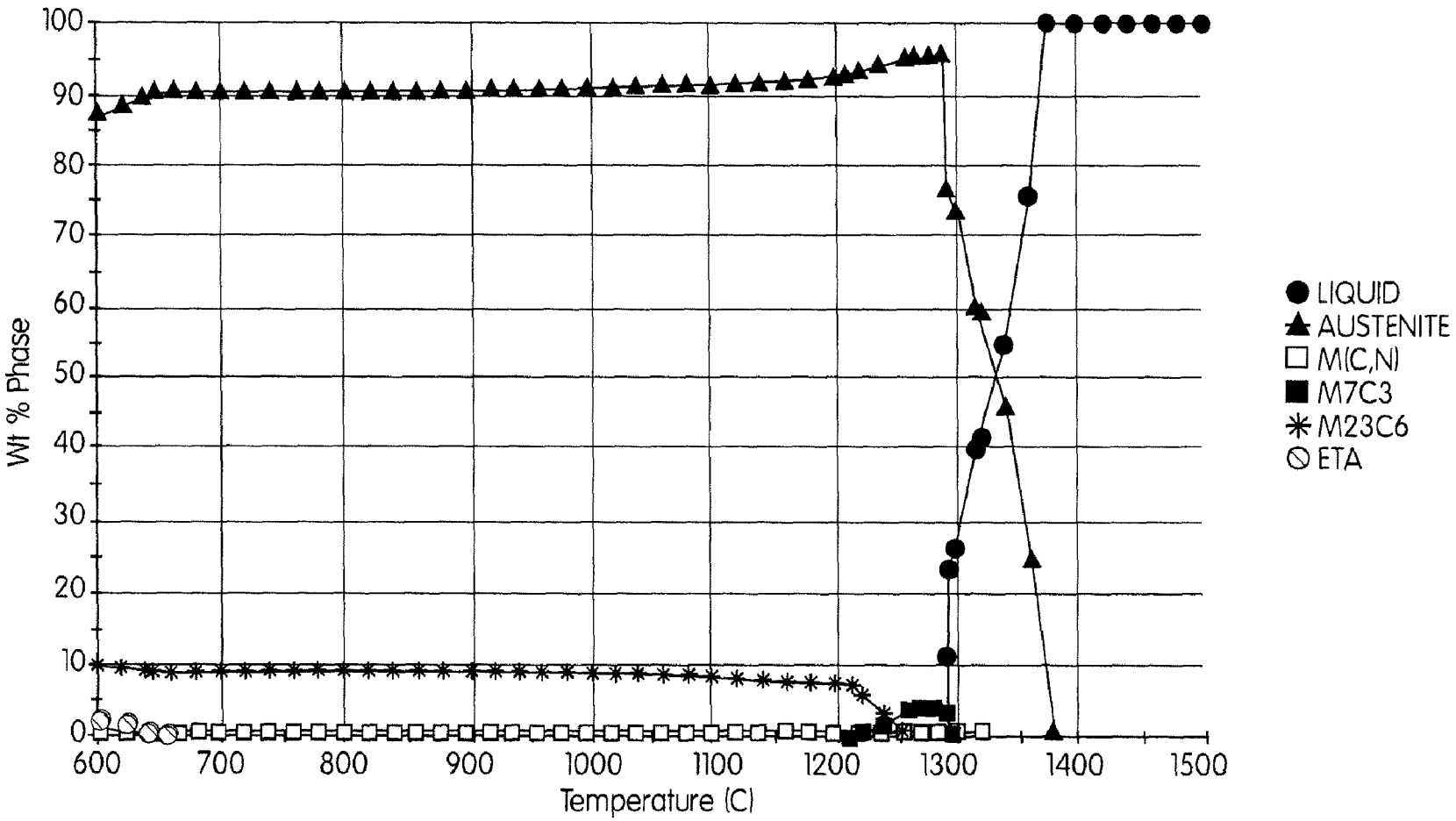
FIG. 4 illustrates equilibrium thermodynamic calculations showing phases present at various temperatures in HP-14R1 alloy, having a composition of: about 0.6 wt. % C, about 23.6 wt. % Cr, about 35.5 wt. % Ni, about 1.0 wt. % Mn, about 0.7 wt. % Si, about 0.85 wt. % Mo, about 0.34 wt. % Nb, about 0.07 wt. % W, about 0.4 wt. % Ti, about 0.1 wt. % Zr, and the rest Fe.
Figure 5:
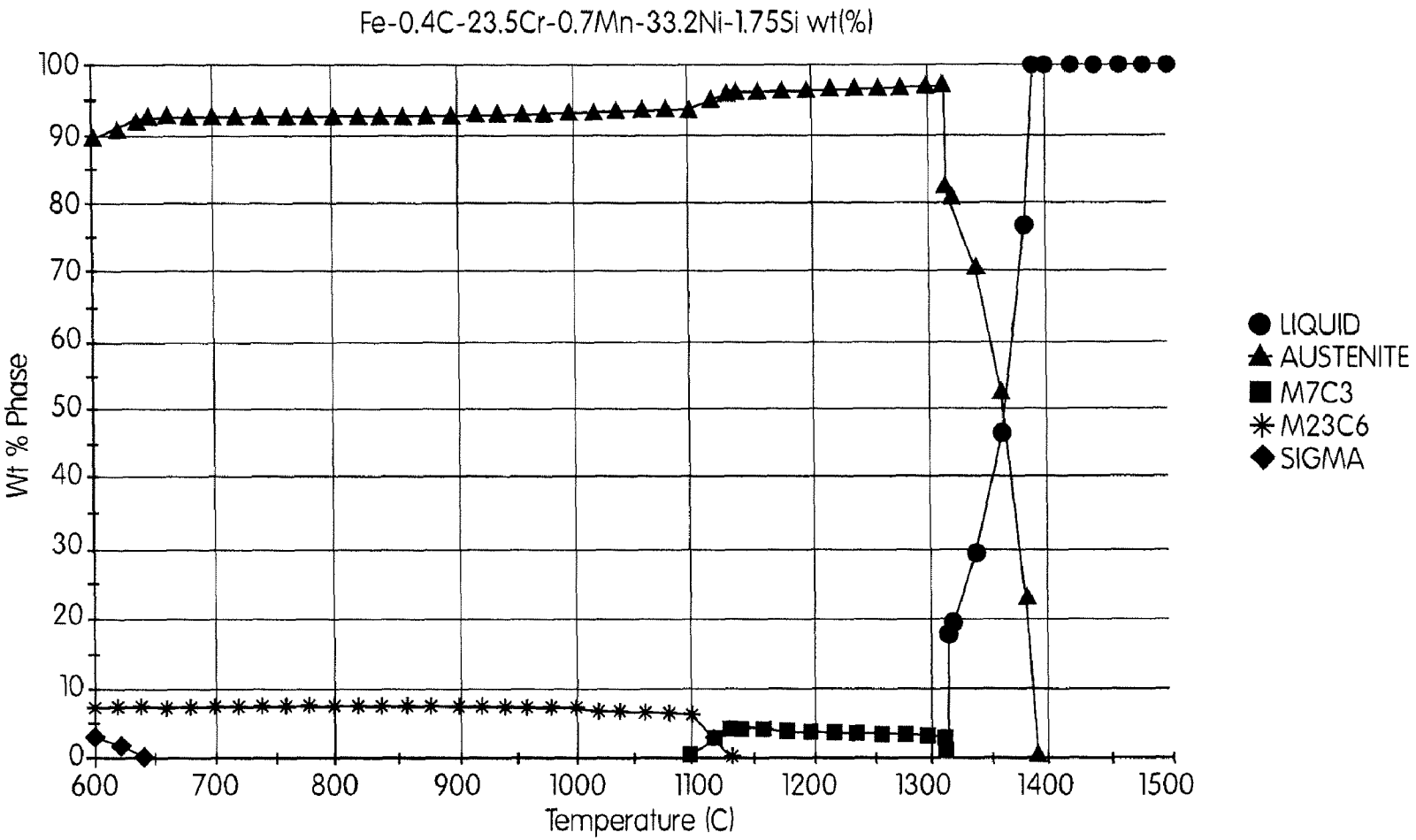
FIG. 5 illustrates equilibrium thermodynamic calculations showing phases present at various temperatures in HP-40 alloy, having a composition of: about 0.4 wt. % C, about 23.5 wt. % Cr, about 0.7 wt. % Mn, about 33.2 wt. % Ni, about 1.75 wt. % Si, and the rest Fe.
Figure 6:
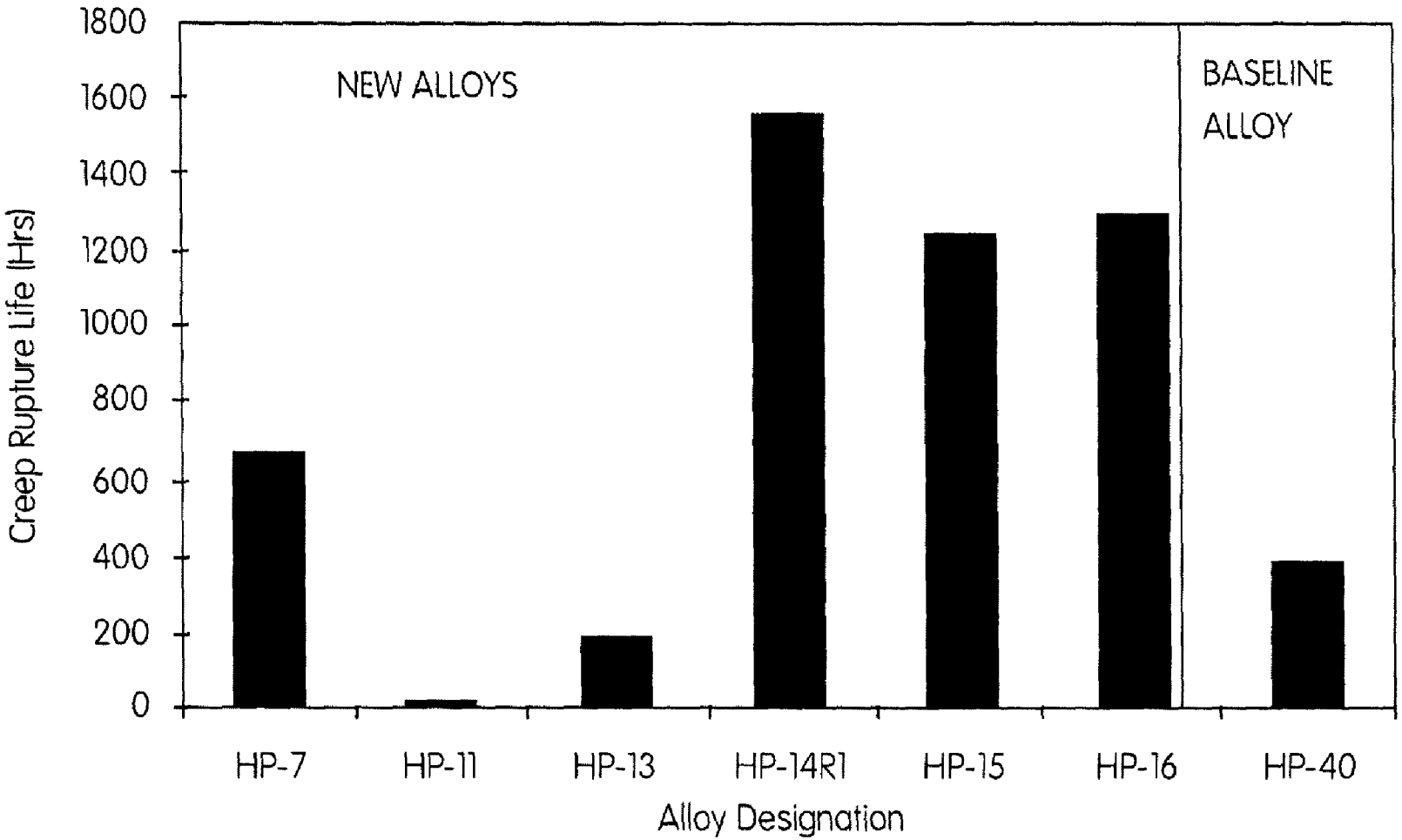
FIG. 6 illustrates a comparison in creep rupture life between new alloys: HP-7, HP-11, HP-13, HP-14R1, HP-15, HP-16 and the HP-40 baseline alloy.

The invention will now be described in detail in relation to the preferred embodiments and implementation thereof which is exemplary in nature and descriptively specific as disclosed. As is customary, it will be understood that no limitation of the scope of the invention is thereby intended. The invention encompasses such alterations and further modifications in the illustrated compositions and methods, and such further applications of the principles of the invention illustrated herein, as would normally occur to persons skilled in the art to which the invention relates.

As used herein in the specification and claims, including as used in the examples and unless otherwise expressly specified, all numbers may be read as if prefaced by the word "about", even if the term does not expressly appear. Also, any numerical range recited herein is intended to include all subranges subsumed therein.

And now with reference to FIGS. 1-9*b*, the present invention is described below. There is a need for low-cost, heat resistant austenitic stainless steels for operation at temperatures up to about 1200° C. and higher. For these alloys, a significant property of interest is creep-resistance, with oxidation resistance being the second most important property. Many of these alloys typically contain significant quantities of Nickel (Ni) (up to about 45 wt. %) along with significant quantities of Cobalt (Co) and Tungsten (W) making the alloys very expensive. A primary motivation of the present invention is the development of alloy compositions that are lower in cost than existing alloys but which have comparable or improved creep properties when tested in a typical environment, such as but not limited to air. The alloys identified in a preferred embodiment of the present invention are Iron-Nickel-Chromium (Fe—Ni—Cr) alloys with the composition of the alloys in the typical range of:

Carbon: about 0.2 to about 0.7 wt. %;
Chromium: about 20 to about 40 wt. %;
Nickel: about 25 to about 60 wt. %;
Manganese: about 0.1 to about 2.5 wt. %;
Silicon: about 0.1 to about 2.5 wt. %;
Niobium: up to about 2.0 wt. %;
Tungsten: up to about 2.0 wt. %;
Molybdenum: up to about 2.0 wt. %;
Titanium: up to about 1.0 wt. %; (optional)
Zirconium: up to about 1.0 wt. %; (optional) and,
Iron: Rest/remainder The alloying element additions in the preferred embodiments of the present invention are kept to a minimum along with decreased Nickel (Ni) contents, which lowers the cost of the alloy. The preferred alloy compositions have been derived through a novel methodology that emphasizes the role of microstructure over that of each specific alloying element.

This methodology of the present invention involves the consideration of certain reference compositions of HP and HK alloys. Using these compositions as a starting point, the effect of the addition of alloying elements on the stabilities of $M_{23}C_6$ and MC are calculated using thermodynamic models. Sufficient alloying element additions are used to stabilize the strengthening phases at the required temperature (for example about 2200° F.), as indicated by results of the thermodynamic calculations, while minimizing the formation of deleterious topologically closed packed phases at low temperatures. The focus of the methodology is on high temperatures since an aim of the invention is to increase the operating temperature of alloys. The following describes some examples of the methodology.

Figure 7A:
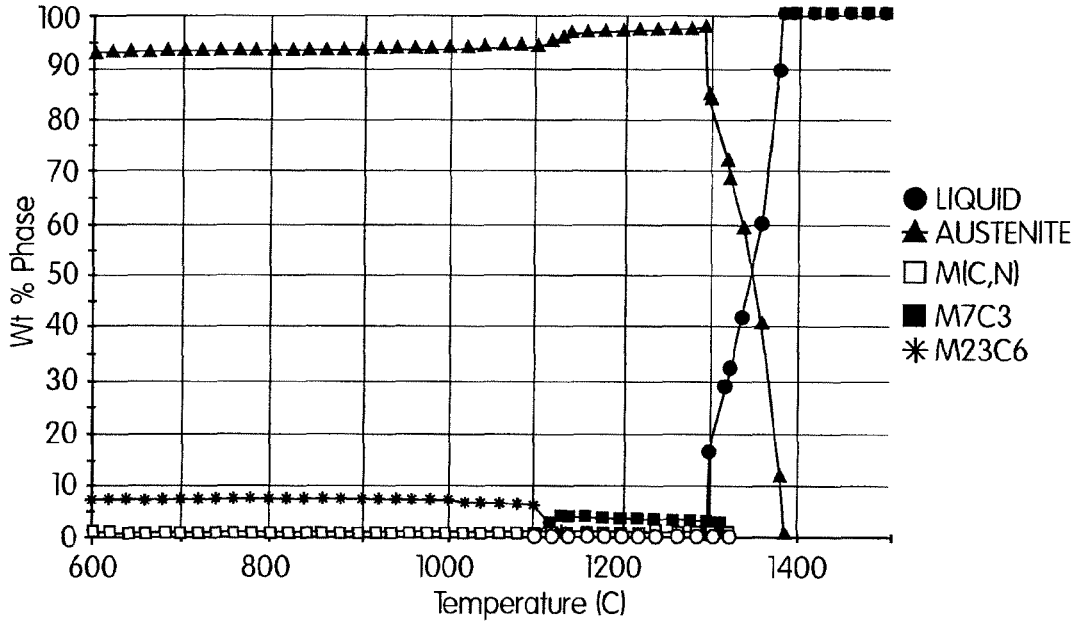
FIG. 7(*a*) illustrates the thermodynamic calculations for HP-11.
Figure 7B:
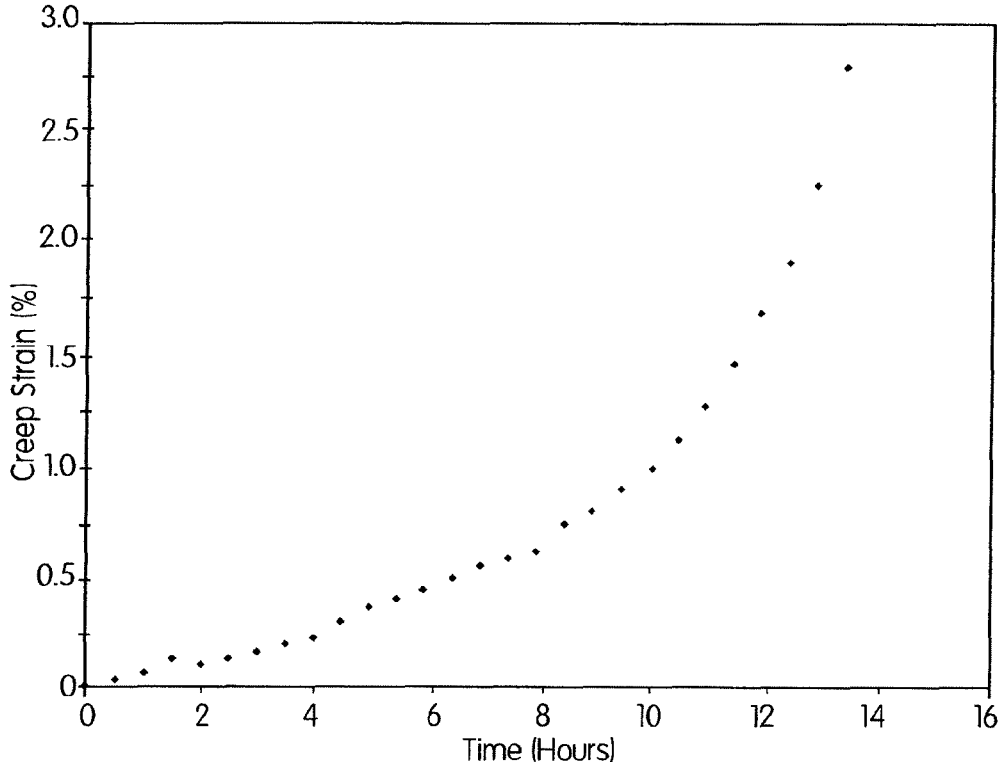

FIG. 7(*a*) shows thermodynamic predictions for phase equilibria in an alloy HP-11 with poor creep performance at about 2200° F. (creep rupture life of about 14 hours at a stress of about 500 psi) (see FIG. 7(*b*)). Specifically FIGS. 7(*a*) and 7(*b*) show that the $M_{23}C_6$ carbides are predicted to be stable only up to about 2100° F. and are replaced by $M_7C_3$ carbides above this temperature. The approach adopted in this methodology is to add alloying elements to extend the range of stability of $M_{23}C_6$ carbides to higher temperatures.

Figure 8A:
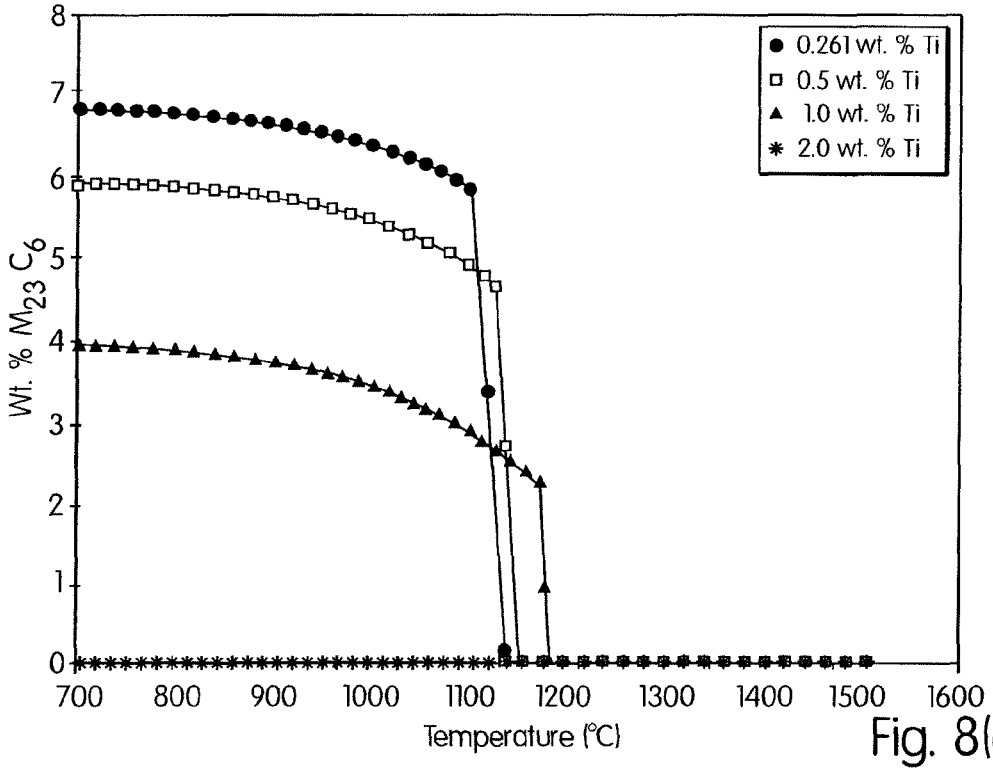
FIGS. 8(*a*) and 8(*b*) illustrate thermodynamic calculations showing the effect of Titanium additions on the stabilities of $M_{23}C_6$ and MC.
Figure 8B:
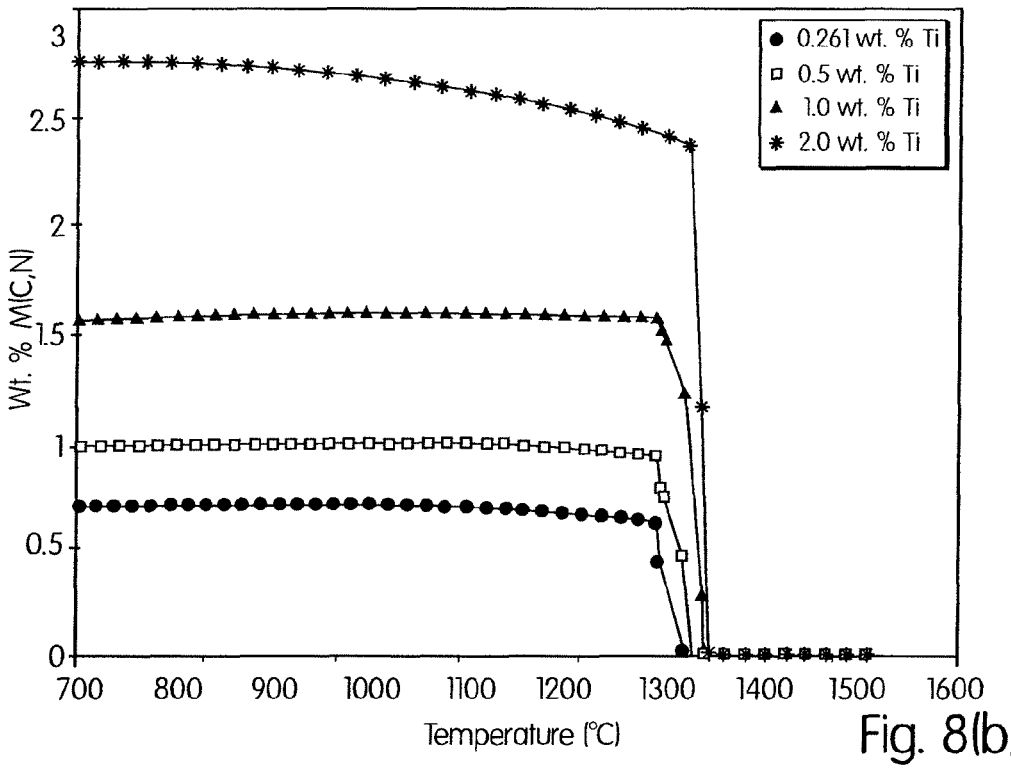

FIGS. 8(*a*) and 8(*b*) illustrate the effects of the addition of varying levels of Titanium, one of the commonly used alloying elements, on the stabilities of the $M_{23}C_6$ and MC carbides in HP-11. As increasing levels of Titanium are added, the $M_{23}C_6$ content in the alloy decreases while correspondingly, the MC content increases. The highest temperature at which the $M_{23}C_6$ carbide remains stable increases slightly with the addition of Titanium.

Figure 9A:
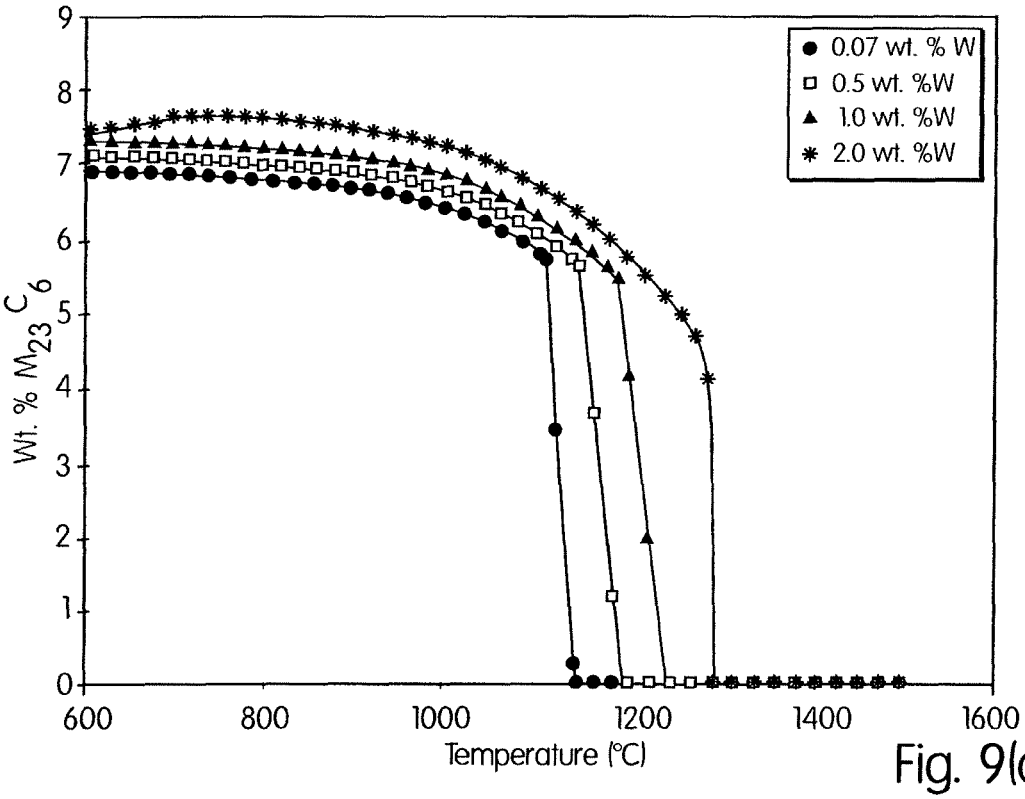
FIGS. 9(*a*) and 9(*b*) illustrate thermodynamic calculations showing the effect of Tungsten additions on the stabilities of $M_{23}C_6$ and MC carbides.
Figure 9B:
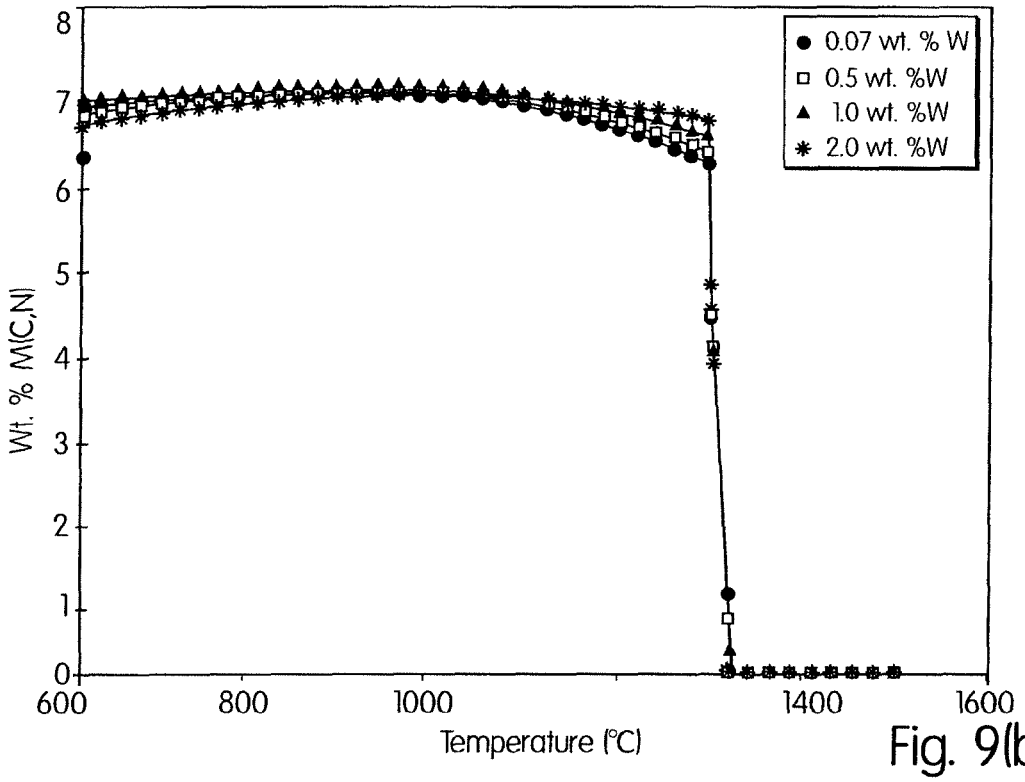

FIGS. 9(*a*) and 9(*b*) disclose the effect of the addition of varying levels of Tungsten on the stabilities of the $M_{23}C_6$ and MC carbides. With increasing levels of Tungsten, the highest temperature of stability of the $M_{23}C_6$ carbide increases significantly along with a small increase in the weight % of the carbide phase. Tungsten has very little effect on the MC carbide phase as shown in FIG. 8(*b*). Thus, if a goal is to increase the amount of MC carbide, the addition of Titanium is also desirable as an alloying element. The addition of Tungsten would also be important to increase the amount of $M_{23}C_6$ carbide and to increase its temperature range of stability.

The preferred embodiments of these alloys have been designed based upon certain observed properties for potential alloying elements:

(1) Silicon (Si) contents (about 0.6 to about 2.5 wt. %) are used for ease of casting, carburization resistance, and oxidation resistance;
(2) Nickel (Ni) is restricted to the range of about 25 to about 60 wt. % to reduce the cost of the alloy, although a minimum amount of Nickel content is essential to maintain the austenitic structure;
(3) Chromium (Cr) is essential for oxidation resistance but is a ferrite stabilizer (the selected range of about 20 to about 40 wt. % will provide sufficient corrosion resistance but enables retention of the austenitic structure); and
(4) the intentional addition of Nitrogen (N) is not required to achieve good properties.

In addition to these considerations on the alloying elements, it is well recognized that the phases present in the alloy are related in a complex manner to the nature and extent of alloying element additions. Related inventions have used trial-and-error methods to arrive at a few compositions. In the present invention, thermodynamic calculations were performed to study, systematically, the nature and amount of various phases present in the newly designed alloys at equilibrium at various temperatures. FIGS. 1-5 show summary reports of the phases present as a function of temperature of various alloy compositions of the present invention.

Phases present at temperatures in the range of about 1000° C.-1200° C. include austenite, $M_7C_3$, M(C,N), and $M_{23}C_6$. In particular, differences are observable in the calculated values of the various types of carbides present at about 1200° C. Table 1 shows the two examples of the preferred composition of the alloys. Creep testing was performed in air at about 1204° C. (2200° F.) and about 500 psi.

TABLE 1

Examples of Preferred Embodiments of Compositions, Wt. % and their Creep Life.

| Alloy | C | Cr | Ni | Mn | Si | Mo | W | Nb | Co | Ti | Zr | Fe | Creep Life (Hrs) 1204° C. (2200° F.), 500 psi |
|---|---|---|---|---|---|---|---|---|---|---|---|---|---|
| HP-7 | 0.41 | 23.6 | 34.6 | 1.0 | 0.7 | 0.05 | 0.08 | 0.33 | 0.02 | 0.1 | 0.0 | 38.1 | 675 |
| HP-15 | 0.42 | 23.7 | 35.1 | 1.1 | 0.7 | 0.28 | 0.07 | 0.34 | 0.02 | 0.4 | 0.1 | 37.8 | 1251 |
| HP-16 | 0.41 | 23.4 | 34.3 | 1.0 | 0.7 | 0.5 | 0.1 | 0.34 | 0.02 | 0.3 | 0.0 | 38.9 | 1293 |
| HP-14R1 | 0.6 | 23.6 | 35.5 | 1.0 | 0.7 | 0.85 | 0.07 | 0.34 | 0.02 | 0.4 | 0.1 | 36.8 | 1558 |
| Super-Therm | 0.5 | 25.9 | 34.3 | 0.7 | 1.5 | 0.02 | 4-6 | 0.0 | 14-16 | 0.0 | 0.0 | Rest | 487 |

Table 2 compares the predicted equilibrium wt. % of the $M_7C_3$, M(C,N), and $M_{23}C_6$ in these alloys at about 1200° C. The carbides/carbonitrides are the strengthening phases in these alloys. The increased wt. % carbides correlate well with improved creep properties.

TABLE 2

Examples of Preferred Embodiments of Compositions and the Calculated Wt. % Carbides Present at Equilibrium at about 1200° C.

| Alloy | C | Cr | Ni | Mn | Si | Mo | W | Nb | Co | Ti | Zr | Fe | Wt. % $M_7C_3$ | Wt. % MC | Wt. % $M_{23}C_6$ | Total Wt. % Carbides | Creep Life (Hrs) 1204° C. (2200 F.), 500 psi |
|---|---|---|---|---|---|---|---|---|---|---|---|---|---|---|---|---|---|
| HP-7 | 0.41 | 23.6 | 34.6 | 1.0 | 0.7 | 0.05 | 0.08 | 0.33 | 0.02 | 0.1 | 0.0 | 38.1 | 2.9 | .037 | 0.0 | 3.27 | 675 |
| HP-15 | 0.42 | 23.7 | 35.1 | 1.1 | 0.7 | 0.28 | 0.07 | 0.34 | 0.02 | 0.4 | 0.1 | 37.8 | 0.0 | 0.73 | 3.7 | 4.43 | 1251 |
| HP-16 | 0.41 | 23.4 | 34.3 | 1.0 | 0.7 | 0.5 | 0.1 | 0.34 | 0.02 | 0.3 | 0.0 | 38.9 | 0.0 | 0.6 | 4.0 | 4.6 | 1293 |
| HP-14R1 | 0.6 | 23.6 | 35.5 | 1.0 | 0.7 | 0.85 | 0.07 | 0.34 | 0.02 | 0.4 | 0.1 | 36.8 | 0.0 | 0.74 | 7.1 | 7.84 | 1558 |
| Super-Therm | 0.53 | 25.9 | 34.3 | 0.7 | 1.5 | 0.02 | 4-6 | 0.0 | 14-16 | 0.0 | 0.0 | Rest | 0.0 | 0.0 | 9.6 | 9.6 | 487 |
| HP-40 | 0.4 | 23.5 | 33.2 | 0.7 | 1.75 | — | — | — | — | — | — | 40.45 | 3.5 | 0 | 0 | 3.5 | 389 |

Table 3 shows the highest temperature stabilities of the $M_{23}C_6$ phase and the maximum carbide contents in the three alloys. Notably, the best properties are obtained when both $M_{23}C_6$ and MC are present in the microstructure and in certain amounts.

TABLE 3

Maximum Temperatures of Stability of $M_{23}C_6$ and Maximum wt. % of $M_{23}C_6$ and MC.

| Alloy | Maximum Temperature of Stability of $M_{23}C_6$ (° C.) | Maximum wt. % of $M_{23}C_6$ Between about 600° C. and about 1204° C. | Maximum wt. % of MC Between about 600° C. and about 1204° C. | Creep Life (Hrs) about 1204° C. (2200 F.), about 500 psi |
|---|---|---|---|---|
| HP-7 | 1173 | 6.4 | 0.43 | 675 |
| HP-15 | 1227 | 6.7 | 0.74 | 1251 |
| HP-16 | 1253 | 6.6 | 0.63 | 1293 |
| HP-14R1 | 1267 | 10.1 | 0.75 | 1558 |

The various embodiments of the present invention include all variations on the above-identified compositions, which such variations and analogous compositions will be apparent to those skilled in the art. By way of example, but not limitation, the following preferred element ranges, in combination, have been identified as having improved creep properties:

Carbon: about 0.4 to about 0.7 wt. %;

Chromium: about 20 to about 35 wt. %;

Nickel: about 30 to about 45 wt. %;

Manganese: about 0.5 to about 1.5 wt. %;

Silicon: about 0.6 to about 2.0 wt. %;

Niobium: up to about 1.5 wt. %;

Tungsten: up to about 1.5 wt. %;

Zirconium: about 0.01 to about 1.0 wt. %; (optional)

Molybdenum: all compositions in the range of up to about 1.5 wt. %;

Titanium: all compositions in the range of about 0.01 to about 1.0 wt. %;

Cobalt: about 0.02 wt. %; and

Iron: Rest/remainder

Table 4 shows further examples of preferred embodiments of the alloy of the present invention within the above range, together the calculated wt. % of carbides present at equilibrium at about 1200° C.

TABLE 4

Further Examples of Preferred Embodiments of Compositions and the Calculated Wt. % Carbides Present at Equilibrium at about 1200° C.

| Alloy | C | Cr | Ni | Mn | Si | Nb | W | Zr | Mo | Ti | Fe | Calc. Wt. % $M_7C_3$ | Calc. Wt. % $M_{23}C$ | Calc. Wt. % MC | Total Wt. % Carbides | Creep Life (Hrs) |
|---|---|---|---|---|---|---|---|---|---|---|---|---|---|---|---|---|
| 1 | 0.4 | 24 | 35 | 1.0 | 0.7 | 0.3 | 0.1 | 0.0 | 0.1 | 0.1 | Rest | 2.86 | 0.0 | 0.32 | 3.18 | 714.7 |
| 2 | 0.4 | 24 | 35 | 1.0 | 0.7 | 0.3 | 0.1 | 0.0 | 0.2 | 0.1 | Rest | 1.64 | 1.99 | 0.32 | 3.95 | 793.6 |
| 3 | 0.4 | 24 | 35 | 1.0 | 0.7 | 0.3 | 0.1 | 0.0 | 0.3 | 0.1 | Rest | 0.31 | 4.16 | 0.32 | 4.79 | 872.4 |
| 4 | 0.4 | 24 | 35 | 1.0 | 0.7 | 0.3 | 0.1 | 0.0 | 0.4 | 0.1 | Rest | 0.0 | 4.69 | 0.32 | 5.01 | 951.3 |
| 5 | 0.4 | 24 | 35 | 1.0 | 0.7 | 0.3 | 0.1 | 0.0 | 0.5 | 0.1 | Rest | 0.0 | 4.74 | 0.32 | 5.06 | 1030.2 |
| 6 | 0.4 | 24 | 35 | 1.0 | 0.7 | 0.3 | 0.1 | 0.0 | 0.1 | 0.2 | Rest | 2.51 | 0.22 | 0.43 | 3.16 | 846.2 |
| 7 | 0.4 | 24 | 35 | 1.0 | 0.7 | 0.3 | 0.1 | 0.0 | 0.2 | 0.2 | Rest | 0.96 | 2.73 | 0.43 | 4.12 | 925.1 |
| 8 | 0.4 | 24 | 35 | 1.0 | 0.7 | 0.3 | 0.1 | 0.0 | 0.3 | 0.2 | Rest | 0.0 | 4.31 | 0.43 | 4.74 | 1003.9 |
| 9 | 0.4 | 24 | 35 | 1.0 | 0.7 | 0.3 | 0.1 | 0.0 | 0.4 | 0.2 | Rest | 0.0 | 4.36 | 0.43 | 4.79 | 1082.8 |
| 10 | 0.4 | 24 | 35 | 1.0 | 0.7 | 0.3 | 0.1 | 0.0 | 0.5 | 0.2 | Rest | 0.0 | 4.41 | 0.43 | 4.84 | 1161.7 |
| 11 | 0.4 | 24 | 35 | 1.0 | 0.7 | 0.3 | 0.1 | 0.0 | 0.1 | 0.3 | Rest | 1.77 | 1.04 | 0.55 | 3.36 | 977.7 |
| 12 | 0.4 | 24 | 35 | 1.0 | 0.7 | 0.3 | 0.1 | 0.0 | 0.2 | 0.3 | Rest | 0.23 | 3.53 | 0.55 | 4.31 | 1056.6 |
| 13 | 0.4 | 24 | 35 | 1.0 | 0.7 | 0.3 | 0.1 | 0.0 | 0.3 | 0.3 | Rest | 0.0 | 3.95 | 0.55 | 4.5 | 1135.4 |
| 14 | 0.4 | 24 | 35 | 1.0 | 0.7 | 0.3 | 0.1 | 0.0 | 0.4 | 0.3 | Rest | 0.0 | 3.99 | 0.55 | 4.54 | 1214.3 |
| 15 | 0.4 | 24 | 35 | 1.0 | 0.7 | 0.3 | 0.1 | 0.0 | 0.5 | 0.3 | Rest | 0.0 | 4.04 | 0.55 | 4.59 | 1293.2 |
| 16 | 0.4 | 24 | 35 | 1.0 | 0.7 | 0.3 | 0.1 | 0.0 | 0.1 | 0.4 | Rest | 0.98 | 1.91 | 0.67 | 3.57 | 1109.2 |
| 17 | 0.4 | 24 | 35 | 1.0 | 0.7 | 0.3 | 0.1 | 0.0 | 0.2 | 0.4 | Rest | 0.0 | 3.51 | 0.67 | 4.19 | 1188.1 |
| 18 | 0.4 | 24 | 35 | 1.0 | 0.7 | 0.3 | 0.1 | 0.0 | 0.3 | 0.4 | Rest | 0.0 | 3.56 | 0.67 | 4.23 | 1266.9 |
| 19 | 0.4 | 24 | 35 | 1.0 | 0.7 | 0.3 | 0.1 | 0.0 | 0.4 | 0.4 | Rest | 0.0 | 3.61 | 0.67 | 4.28 | 1345.8 |
| 20 | 0.4 | 24 | 35 | 1.0 | 0.7 | 0.3 | 0.1 | 0.0 | 0.5 | 0.4 | Rest | 0.0 | 3.66 | 0.67 | 4.33 | 1424.7 |

The total calculated wt. % of the carbides in these preferred embodiments of the alloys of the present invention is in the range about 3.18 wt. % to about 5.06 wt. % and hence lies between the previously identified preferred embodiments. As such, the creep properties of these alloys are also improved over that of related alloys.

A further preferred embodiment of the cast heat-resistant austenitic steel alloy with improved temperature creep properties and balanced alloyed elements additions, is comprised of about 0.4 to about 0.7 wt. % Carbon; about 20 to about 35 wt. % Chromium; about 30 to about 45 wt. % Nickel; about 0.5 to about 1.5 wt. % Manganese; about 0.6. to about 2.0 wt. % Silicon; up to about 1.5 wt. % Niobium; up to about 1.5 wt. % Tungsten; up to about 1.5 wt. % Molybdenum; and the remainder being Iron. In one preferred embodiment, the alloy further comprises about 0.01 to about 1.0 wt. % Titanium and/or about 0.01 to about 1.0 wt. % Zirconium. In a preferred embodiment, the alloy is also comprised of about 0.02 wt. % Cobalt. The creep life of the alloy at about 1200° C. and about 500 psi is in excess of about 600 hours. The alloy has a total wt. % of carbides at about 1200° C. between about 3.18 and about 7.84. The $M_{23}C_6$ and MC carbides are present in the microstructure of the alloy at temperatures up to about 1204° C.

The alloy of the present invention has the following composition in another preferred embodiment: about 0.41 wt. % Carbon; about 23.6 wt. % Chromium; about 34.6 wt. % Nickel; about 1.0 wt. % Manganese; about 0.7 wt. % Silicon; about 0.05 wt. % Molybdenum; about 0.08 wt. % Tungsten; about 0.33 wt. % Niobium; about 0.02 wt. % Cobalt; about 0.1 wt. % Titanium; and the remainder being Iron. This preferred composition has a maximum temperature of stability of $M_{23}C_6$ carbide of about 1173° C.; a maximum wt. % of $M_{23}C_6$ between about 600° C. and about 1500° C. of about 6.4; a maximum wt. % of MC between about 600° C. and about 1500° C. of about 0.43; and a creep life at about 1204° C. (2200° F.) and about 500 psi of about 675 hours.

The alloy of the present invention has the following composition in yet another preferred embodiment: about 0.42 wt. % Carbon; about 23.7 wt. % Chromium; about 35.1 wt. % Nickel; about 1.1 wt. % Manganese; about 0.7 wt. % Silicon; about 0.28 wt. % Molybdenum; about 0.07 wt. % Tungsten; about 0.34 wt. % Niobium; about 0.02 wt. % Cobalt; about 0.4 wt. % Titanium; about 0.1 wt. % Zirconium; and the remainder being Iron. This preferred composition has a maximum temperature of stability of $M_{23}C_6$ carbide of about 1227° C.; a maximum wt. % of $M_{23}C_6$ between about 600° C. and about 1500° C. of about 6.7; a maximum wt. % of MC between about 600° C. and about 1500° C. of about 0.74; and a creep life at about 1204° C. (2200° F.) and about 500 psi of about 1251 hours.

The alloy of the present invention has the following composition in yet another preferred embodiment: about 0.41 wt. % Carbon; about 23.4 wt. % Chromium; about 34.34 wt. % Nickel; about 1.0 wt. % Manganese; about 0.7 wt. % Silicon; about 0.5 wt. % Molybdenum; about 0.34 wt. % Niobium; about 0.1 wt. % Tungsten; about 0.3 wt. % Titanium; and the remainder being Iron. This preferred composition has a maximum temperature of stability of $M_{23}C_6$ carbide of about 1253° C.; a maximum wt. % of $M_{23}C_6$ between about 600° C. and about 1500° C. of about 6.6; a maximum wt. % of MC between about 600° C. and about 1500° C. of about 0.63; and a creep life at about 1204° C. (2200° F.) and about 500 psi of about 293 hours.

The alloy of the present invention has the following composition in another preferred embodiment: about 0.6 wt. % Carbon; about 23.6 wt. % Chromium; about 35.5 wt. % Nickel; about 1.0 wt. % Manganese; about 0.7 wt. % Silicon; about 0.85 wt. % Molybdenum; about 0.34 wt. % Niobium; about 0.07 wt. % Tungsten; about 0.4 wt. % Titanium; about 0.1 wt. % Zirconium; and the remainder being Iron. This composition has a maximum temperature of stability of $M_{23}C_6$ carbide of about 1267° C.; a maximum wt. % of $M_{23}C_6$ between about 600° C. and about 1500° C. of about 10.1; a maximum wt. % of MC between about 600° C. and about 1500° C. of about 0.75; and a creep life at about 1204° C. (2200° F.) and about 500 psi of about 1558 hours.

Another preferred embodiment of the cast heat-resistant austenitic steel alloy of the present invention with improved temperature creep properties and balanced alloyed element additions is comprised of: about 0.4 wt. % Carbon; about 24 wt. % Chromium; about 35 wt. % Nickel; about 1.0 wt. % Manganese; about 0.7 wt. % Silicon; about 0.3 wt. % Niobium; about 0.08 wt. % Tungsten; less than about 0.1 wt. % Zirconium; about 0.05 to about 0.5 wt. % Molybdenum; about 0.1 to about 0.4 wt. % Titanium; and the rest being Iron. This alloy has a total calculated wt. % of carbides in the range of about 3.18 to about 5.06.

The present invention further includes a preferred method of making the cast heat-resistant austenitic steel alloy with improved temperature creep properties and balanced alloyed elements additions of the present invention, which comprises the steps of: evaluating compositions of HP and HK alloys; calculating the effect of an addition of alloying elements on the stability of $M_{23}C_6$ and MC utilizing thermodynamic models; using the HP and HK alloys as a base reference for said calculations; and whereby said alloying element additions are used to stabilize strengthening phases at a required temperature as indicated by the results of the thermodynamic calculations to provide improved creep-resistance.

It is to be understood that the present invention is not limited to the preferred embodiments described above, but encompasses any and all embodiments within the scope of the description and any claims subsequently added hereto.

We claim:

1. A cast austenitic steel alloy consisting of:
about 0.4 to about 0.7 wt. % carbon;
about 20 to about 35 wt. % chromium;
about 30 to 36 wt. % nickel;
about 0.5 to 1.1 wt. % manganese;
about 0.6 to about 2.0 wt. % silicon;
about 0.1 to 0.4 wt. % niobium;
up to about 1.5 wt. % tungsten;
up to about 1.5 wt. % molybdenum;
0.1 to about 0.4 wt. % titanium, and,
the remainder being iron;
wherein the alloy does not contain additions of nitrogen; and
wherein the total wt. % of carbides in said alloy at about 1200° C. is between about 3.18 and about 7.84.

2. A cast austenitic steel alloy consisting of:
about 0.4 to about 0.7 wt. % carbon;
about 20 to about 35 wt. % chromium;
about 30 to 36 wt. % nickel;
about 0.5 to 1.1 wt. % manganese;
about 0.6 to about 2.0 wt. % silicon;
about 0.1 to 0.4 wt. % niobium;
up to about 1.5 wt. % tungsten;
up to about 1.5 wt. % molybdenum;
0.1 to about 0.4 wt. % titanium;
about 0.01 to about 1.0 wt. % zirconium, and,
the remainder being iron;
wherein the alloy does not contain additions of nitrogen; and
wherein the total wt. % of carbides in said alloy at about 1200° C. is between about 3.18 and about 7.84.

3. The cast steel alloy of claim 1, wherein the creep life of said alloy at about 1200° C. and about 500 psi is in excess of about 600 hours.

4. The cast austenitic steel alloy of claim 1, wherein $M_{23}C_6$ and MC carbides are present in the microstructure of said alloy at high temperatures up to about 1204° C.

5. A cast austenitic steel alloy consisting of:
about 0.41 wt. % carbon;
about 23.6 wt. % chromium;
about 34.6 wt. % nickel;
about 1.0 wt. % manganese:
about 0.7 wt. % silicon;
about 0.05 wt. % molybdenum;
about 0.08 wt. % tungsten;
about 0.33 wt. % niobium;
about 0.02 wt. % cobalt;
0.1 wt. % titanium; and
the remainder being iron;
said alloy has a maximum temperature of stability of $M_{23}C_6$ carbide of about 1173° C.; a maximum wt. % of $M_{23}C_6$ between about 600° C. and about 1500° C. of about 6.4; a maximum wt. % of MC between about 600° C. and about 1500° C. of about 0.43; wherein the total wt. % of carbides in said alloy at about 1200° C. is between about 3.18 and about 7.84; and a creep life at about 1204° C. and about 500 psi of about 675 hours.

6. A cast austenitic steel alloy consisting of:
about 0.42 wt. % carbon;
about 23.7 wt. % chromium;
about 35.1 wt. % nickel;
about 1.1 wt. % manganese;
about 0.7 wt. % silicon;
about 0.28 wt. % molybdenum;
about 0.07 wt. % tungsten;
about 0.34 wt. % niobium;
about 0.02 wt. % cobalt;
0.4 wt. % titanium;
about 0.1 wt. % zirconium; and
the remainder being iron;
said alloy having a maximum temperature of stability of $M_{23}C_6$ carbide of about 1227° C.; a maximum wt. % of $M_{23}C_6$ between about 600° C. and about 1500° C. of about 6.7; a maximum wt. % of MC between about 600° C. and austenitic 1500° C. of about 0.74; and
wherein the total wt. % of carbides in said alloy at about 1200° C. is between about 3.18 and about 7.84; and a creep life at about 1204° C. and about 500 psi of about 1251 hours.

7. A cast austenitic steel alloy consisting of:
about 0.41 wt. % carbon;
about 23.4 wt. % chromium;
about 34.34 wt. % nickel;
about 1.0 wt. % manganese;
about 0.7 wt. % silicon;
about 0.5 wt. % molybdenum;
about 0.34 wt. % niobium;
about 0.1 wt. % tungsten;
0.3 wt. % titanium; and
the remainder being iron;
said alloy having a maximum temperature of stability of $M_{23}C_6$ carbide of about 1253° C.; a maximum wt. % of $M_{23}C_6$ between about 600° C. and about 1500° C. of about 6.6; a maximum wt. % of MC between about 600° C. and about 1500° C. of about 0.63; and
wherein the total wt. % of carbides in said alloy at about 1200° C. is between about 3.18 and about 7.84; and a creep life at about 1204° C. and about 500 psi of about 1293 hours.

8. A cast austenitic steel alloy consisting of:
about 0.6 wt. % carbon;
about 23.6 wt. % chromium;
about 35.5 wt. % nickel;
about 1.0 wt. % manganese;

about 0.7 wt. % silicon;
about 0.85 wt. % molybdenum;
about 0.34 wt. % niobium;
about 0.07 wt. % tungsten;
0.4 wt. % titanium;
about 0.1 wt. % zirconium;
the remainder being iron; and
said alloy having a maximum temperature of stability of $M_{23}C_6$ carbide of about 1267° C.; a maximum wt. % of $M_{23}C_6$ between about 600° C. and about 1500° C. of about 10.1; a maximum wt. % of MC between about 600° C. and about 1500° C. of about 0.75;
wherein the total wt. % of carbides in said alloy at about 1200° C. is between about 3.18 and about 7.84; and a creep life at about 1204° C. and about 500 psi of about 1558 hours.

9. A cast austenitic steel alloy consisting of:
about 0.4 wt. % carbon;
about 24 wt. % chromium;
about 35 wt. % nickel;
about 1.0 wt. % manganese;
about 0.7 wt. % silicon;
about 0.3 wt. % niobium;
about 0.08 wt. % tungsten;
about 0.5 to about 1.5 wt. % molybdenum;
0.1 to about 0.4 wt. % titanium; and,
the rest being iron, and
wherein the total wt. % of carbides in said alloy at about 1200° C. is between about 3.18 and about 7.84.

10. A cast austenitic steel alloy consisting of:
about 0.4 wt. % carbon;
about 24 wt. % chromium;
about 35 wt. % nickel;
about 1.0 wt. % manganese;
about 0.7 wt. % silicon;
about 0.3 wt. % niobium;
about 0.08 wt. % tungsten;
about 0.5 to about 1.5 wt. % molybdenum;
0.1 to about 0.4 wt. % titanium;
less than about 0.1 wt. % zirconium; and,
the rest being iron, and
wherein the total wt. % of carbides in said alloy at about 1200° C. is between about 3.18 and about 7.84.

11. The cast austenitic steel alloy of claim 9, said alloy having a total calculated wt. % of carbides in the range of about 3.18 to about 5.06.

* * * * *